United States Patent [19]

Hinz

[11] 4,092,650

[45] May 30, 1978

[54] GROUPED STYLUS ELECTROSTATIC RECORDING HEAD

[75] Inventor: Hans-Dieter Hinz, Tornesch, Germany

[73] Assignee: U.S. Philips Corporation, New York, N.Y.

[21] Appl. No.: 726,457

[22] Filed: Sep. 24, 1976

Related U.S. Application Data

[63] Continuation of Ser. No. 586,517, Jun. 12, 1975, abandoned.

[30] Foreign Application Priority Data

Jun. 18, 1974 Germany ..... 2429114

[51] Int. Cl.[2] ..... G03G 15/044

[52] U.S. Cl. ..... 346/155; 346/163

[58] Field of Search ..... 346/153, 154, 155, 165, 346/162, 163, 164, 139 C; 358/300

[56] References Cited

U.S. PATENT DOCUMENTS

| | | | |
|---|---|---|---|
| Re. 26,212 | 5/1967 | Johnson | 346/153 |
| 2,716,826 | 9/1955 | Huebner | 346/155 |
| 2,830,867 | 4/1958 | Kohn | 346/165 |
| 2,918,580 | 12/1959 | Howell | 346/153 |
| 3,119,919 | 1/1964 | Pratt | 346/163 |
| 3,354,817 | 11/1967 | Sakurai | 346/165 |
| 3,380,069 | 4/1968 | Hojo | 346/155 |
| 3,626,422 | 12/1971 | Lloyd | 346/153 |

*Primary Examiner*—Jay P. Lucas

*Attorney, Agent, or Firm*—Frank R. Trifari; Robert S. Smith

[57] ABSTRACT

An electrostatic recording device for the recording of grey shades which are obtained by variation of the number of image dot elements per image dot. Each pin-shaped recording electrode consists of several sub-electrodes which are electrically insulated with respect to each other and which are divided into groups. Each of these groups is separately electrically switchable.

4 Claims, 5 Drawing Figures

GROUPED STYLUS ELECTROSTATIC RECORDING HEAD

Figure 1A:
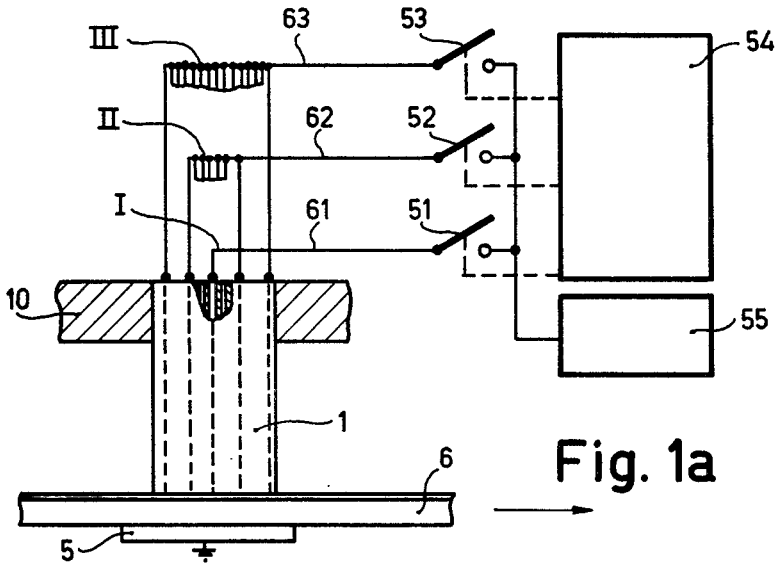

This is a continuation, of application Ser. No. 586,517, filed June 12, 1975 now abandoned.

The invention relates to an electrostatic recording device, comprising pin-shaped recording electrodes for the formation of a latent recording in the form of dots, wherein a high voltage can be applied to the recording electrode by a control circuit.

For the dot-wise recording of an electrostatic image, for example, for the black-white facsimile printing of alphanumerical characters, line segments and complete fields, the record carrier is passed between a large number of pin-shaped recording electrodes and a common counter-electrode. To this end, the recording electrodes can be adjacently arranged in a row (German Auslegeschrift No. 2,150,715) or be alternately arranged (U.S. Pat. No. 2,997,361) or be arranged in a matrix (Canadian Pat. No. 641,386).

In all these known devices the required high voltage can be individually applied to each recording electrode by a control circuit. The recording of the latent image dots is then effected by igniting a Townsend gas discharge (ionisation) in the space between the end faces of the recording electrodes and the insulating upper layer of the record carrier. The dimensions and the charge density of the image dots are not only determined by the shape and the arrangement of the recording electrodes, but inter alia also by the value of the applied high voltage pulse for the given air gap (Paschen's law), and by the parameters of the record carrier and the surroundings (for example, air humidity). The latent electrostatic charge image dots are made visible — also referred to as development — in a developing chamber which is arranged behind the recording head and which contains electroscopic powder (toner) or a liquid in which toner particles are suspended. Depending on the charge density, more or less toner is deposited on the image dot, so that different grey values can occur. Subsequently, the visible image is fixed, for example, by heating the toner in a further station.

The recording electrodes of the known devices are of a solid construction and are embedded in insulating material. They have a round or rectangular section.

For the electrostatic facsimile grey printing for photographs and the like it would in principle be possible to vary the charge image dimensions and the charge density by controlling the value of the high voltage pulse, so that grey values can be reproduced.

However, in practice it was found that the reproducibility and the reliability of such methods are comparatively poor. This situation can be improved only at great expense.

The invention has for its object to achieve the realisation of the grey phases from white up to and including the optimum black, including proper trace images and characters, for electrostatic facsimile grey printing in a comparatively simple and suitably reproducible manner. To this end, the device according to the invention is characterized in that each recording electrode consists of various sub-electrodes which are electrically insulated with respect to each other and which are divided into groups, each group being separately electrically switchable. Each image dot is thus composed of a very large number of very small image dot elements having a uniform density per se. The grey values must arise from variation of the number of image dot elements per image dot. The peripheral portion of the image dot, determining the distance between adjacent dots in a matrix of image dots, should preferably be square.

The invention will be described in detail hereinafter with reference to a number of preferred embodiments which are shown in the diagrammatic drawing.

Figure 1B:
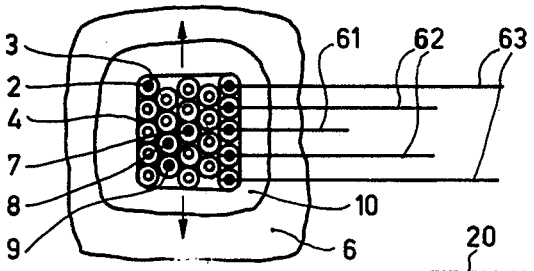

FIGS. 1A and 1B diagrammatically show the technological construction of a first embodiment of a recording electrode according to the invention in a side elevation and a plan view, respectively.

Figure 2A:
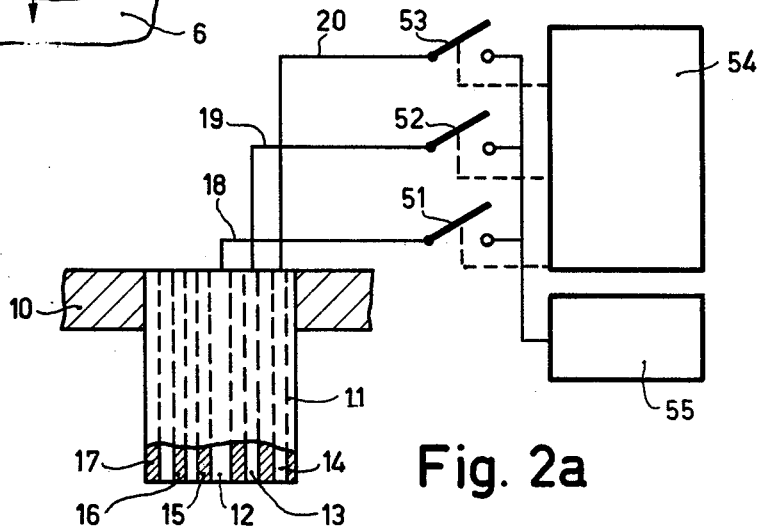
Figure 2B:
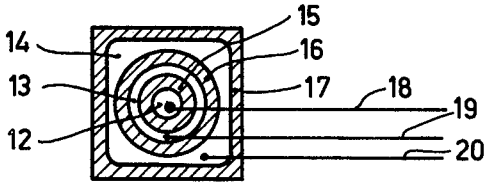
Figure 3:
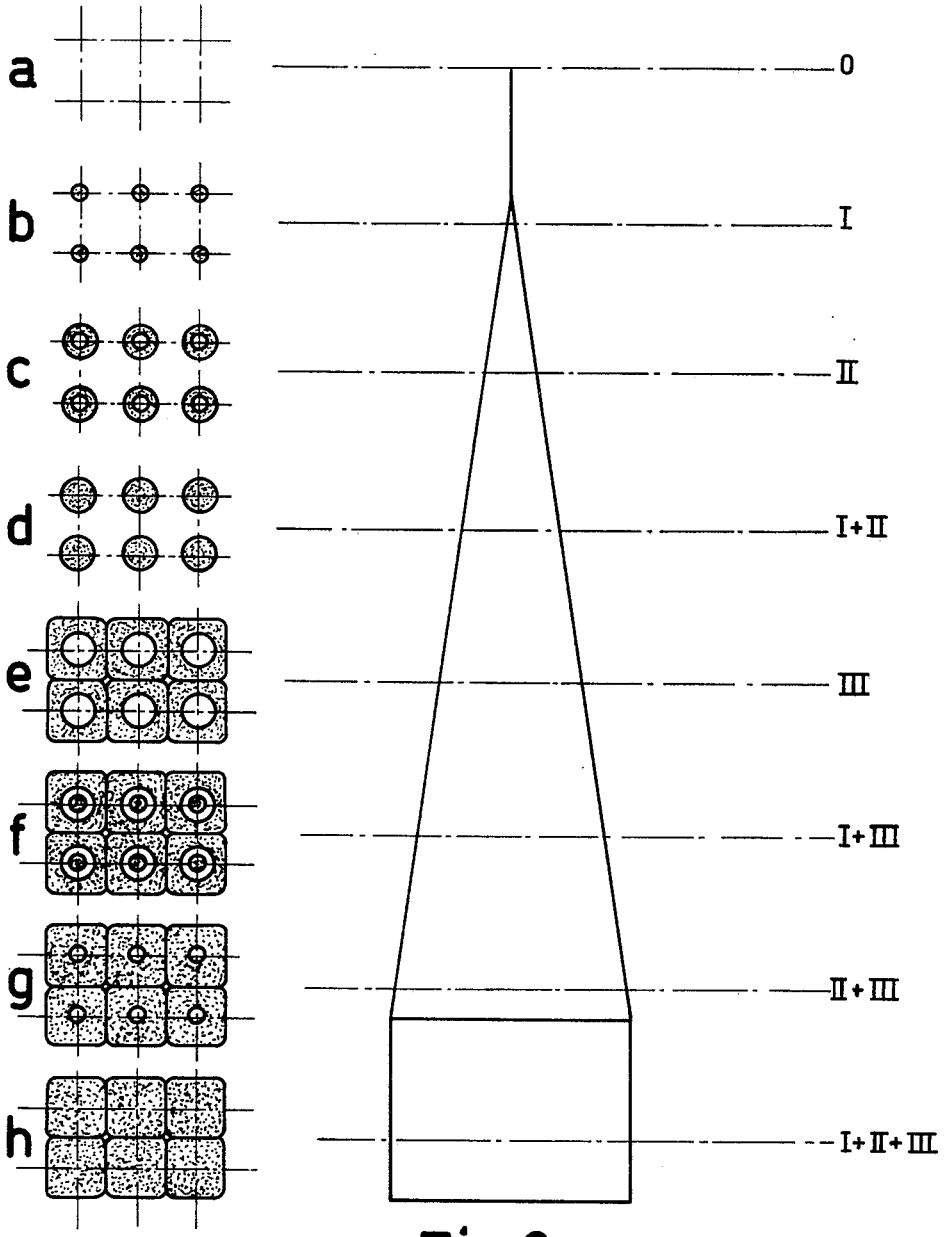

FIG. 2A and 2B diagrammatically show a second embodiment of a recording electrode according to the invention, again in a side elevation and a plan view, respectively, and FIG. 3, consisting of *a* through *h*, shows charge images developed by means of black toner and formed on the basis of the variation possibilities of the recording electrode according to the invention.

FIGS. 1A and B show a recording electrode 1 in a side elevation and a plan view, respectively, the construction of this electrode being of the "wire-type". For the construction of the recording electrode, twenty-three wires are provided, each of which acts as a separate recording electrode when connected to a high voltage. The electrodes consist of a metal core 2 and a jacket 3 of high-quality insulating material. All twenty-three wires are moulded into a square shape in an insulating material 4. The twenty-three wires are arranged in rings around a central electrode 7. In the present case there are two rings 8 and 9. In order to achieve the square shape of the complete electrode, four further corner wires are added to the outer ring 9. The central separate wire 7 and the two rings 8 and 9 each time form a separate group I, II, III, each of which is electrically connected to an associated high voltage switch 51, 52, 53 via conductors 61, 62, 63, respectively. Via these high voltage switches, a control circuit 54 applies a high voltage, originating from a high voltage generator 55, at option to one group, two groups or all groups.

The complete electrode 1, consisting of the separate electrodes 7, 8 and 9, is accommodated in a movable mount 10 in known manner. The electrode 1 is arranged opposite a counter electrode 5 which is connected for example, to earth potential. A record carrier 6 is continuously moved in the recording direction between these two electrodes. The movement of the recording electrode 1 is orthogonal with respect to this transport movement.

FIGS. 2A and B show a second embodiment according to the invention in a side elevation and a plan view, respectively, which is referred to as a "sleeve type". The individual electrodes of the complete recording electrode 11 are in this case formed as sleeves 13 and 14 which coaxially envelop the solid central electrode 12, each sub-electrode 12, 13, 14, forming one of the groups I, II, III. In as far as a square image dot is to be obtained, the outer sleeve 14 can be enlarged at four corners as appears from the drawing. The sub-electrodes 12, 13, 14 are electrically isolated from each other by insulating jackets 15, 16, 17. The electrical control by means of the high voltage switches 51, 52, 53 and the control circuit 54 is effected via the added lines 18, 19 and 20 in the same manner as shown in FIG. 1.

The formation of a complete recording electrode from wires or sleeves and the separate actuation of the individual electrode groups determined thereby, enable $2^3 = 8$ actuation combinations by the high voltage switches 51, 52, 53 when only three groups are chosen. Using these eight possibilities, the eight density degrees *a* to *h* shown in FIG. 3 can be achieved. FIG. 3 shows, for the sake of simplicity, six developed charge image dots of a matrix such as provided on the record carrier by a suitable electrostatic recording apparatus incorporating the electrostatic recording device according to the invention. For the sake of simplicity, the individual image dot elements are not shown. The wedge-like shape in the central column of FIG. 3 represents the density of printing. The wider this wedge, the greater the density of the printed image. In the case *a,* none of the electrode groups is switched on. This means that no recording takes place. In the case *b,* only the electrode group I, i.e. the central electrode 7, is switched on. The latent image to be developed in this case represents the lowest grey value. When the separate electrode groups I, II, and III are successively switched in a combination which is shown in the righthand column of FIG. 3, a facsimile printing with six grey values plus back and white can be performed. In this case, the group II implies the sub-electrodes 8 and 13, and the group III implies the outer sub-electrodes 9 and 14. The charge image dimensions, the sereen dimensions and the number and succession of the grey values can be influenced, by a suitable choice of the number of electrode groups, their shape and dimensions, and the organisation of the control.

What is claimed is:

1. An electrostatic recording device for producing an image on an associated record carrier comprising: means for producing gray tones including a plurality of elongated recording electrodes for the formation of a latent recording in the form of a dot by each electrode when a high voltage is applied to said recording electrodes, each of said elongated recording electrodes comprising a plurality of sub-electrodes which are electrically insulated with respect to each other; each of said sub-electrodes being spaced from each adjacent sub-electrode a distance which is less than the minimum distance to produce an image on the associated carrier which will have the appearance of a continuous unbroken image when viewed at a normal reading distance, at least one sub-electrode from one recording electrode being electrically connected to at least one sub-electrode from another recording electrode, said sub-electrodes which are electrically connected constituting a group, said device further including switching means for selective switching voltage on each group independently of all other groups, at least two sub-electrodes in any of said recording electrodes being generally circular and disposed in generally concentric relationship, said device further including a generally square electrode disposed in generally coaxial relationship to each other sub-electrode in each of said recording electrodes at least at one axial portion thereof.

2. An electrostatic recording device as claimed in claim 1 wherein said switching means includes a plurality of high voltage switches, a common control circuit and a high voltage generator, said common control circuit selectively switching each of said high voltage switches, each of said high voltage switches upon closing connecting one of said groups to said high voltage generator.

3. An electrostatic recording device for producing an image on an associated record carrier, comprising means for producing gray tones including a plurality of elongated recording electrodes for the formation of a latent recording in the form of a dot by each electrode when a high voltage is applied to said recording electrodes, each of said elongated recording electrodes comprising a plurality of sub-electrodes which are electrically insulated with respect to each other; each of said sub-electrodes being spaced from each adjacent sub-electrode a distance which is less than the minimum distance to produce an image on the associated carrier which will have the appearance of a continuous unbroken image when viewed at a normal reading distance, at least one sub-electrode from one recording electrode being electrically connected to at least one sub-electrode from another recording electrode, said sub-electrodes which are electrically connected constituting a group, said device further including switching means for selective switching voltage on each group independently of all other groups, at least two of said sub-electrodes having an annular shape and being disposed about a single central sub-electrode.

4. An electrostatic recording device as claimed in claim 3 wherein said switching means includes a plurality of high voltage switches, a common control circuit and a high voltage generator, said common control circuit selectively switching each of said high voltage switches, each of said high voltage switches upon closing connecting one of said groups to said high voltage generator.

* * * * *